United States Patent [19]

Itoh

[11] 4,117,971

[45] Oct. 3, 1978

[54] PAPER CUPS

[75] Inventor: Tsutomu Itoh, Tokyo, Japan

[73] Assignee: Onoda Cement Company, Ltd., Onoda, Japan

[21] Appl. No.: 848,950

[22] Filed: Nov. 7, 1977

[30] Foreign Application Priority Data

Nov. 18, 1976 [JP] Japan ..... 51-154709[U]

[51] Int. Cl.[2] ..... B65D 3/10

[52] U.S. Cl. ..... 229/1.5 B

[58] Field of Search ..... 229/1.5 B

[56] References Cited

U.S. PATENT DOCUMENTS

| | | | |
|---|---|---|---|
| 3,049,277 | 8/1962 | Shappell | 229/1.5 B |
| 3,137,431 | 6/1964 | Crouse et al. | 229/1.5 B |
| 3,164,314 | 1/1965 | Waycie | 229/1.5 B |
| 3,182,882 | 5/1965 | Aellem et al. | 229/1.5 B X |
| 4,016,327 | 4/1977 | Fumei et al. | 229/1.5 B |

*Primary Examiner*—Davis T. Moorhead

*Attorney, Agent, or Firm*—Price, Heneveld, Huizenga & Cooper

[57] ABSTRACT

Forming coating layers at least on the whole inner side wall and top peripheral opening edge of a paper cup with synthetic resin to be closely adhered, also forming a coating layer with synthetic resin on the inside face of a bottom paper plate closely adhered, said coating layer at the lower peripheral edge of said inner side wall and the bottom coating layer are merged to be an integral part along the whole inner face of the cup, thereby leakage of liquid contained therein by penetration from said side wall, particularly from overlapped portion of side wall and from jointed portion of the side wall and bottom plate is prevented; also in the paper cup with a lid, leakage of liquid from the top opening end is prevented.

2 Claims, 16 Drawing Figures

PAPER CUPS

This invention relates to improved paper cups for containing various kinds of drinks and instant foods or so. In these days, a great number of such paper cups come to be needed for slot type selling machines and for the use in households or in parties. However now mostly used conventional type are not suitable for conserving the contained for a long time. This is because these paper cups are such that on the surface of paper material, merely wax is being applied or laminated with synthetic resin for the purpose of waterproof for the contained articles. If such cups are used as containers for a long time, it often happens that leakage occurs from the joint portion, particularly from cracks in the laminated synthetic resin caused by failure in the work of bending or folding work when paper cups are made up from paper or the like material. Therefore it is not possible to conserve liquid or any other foodstuffs for a long time.

One object of the present invention is to eliminate the defects of conventional type paper containers and furnish more improved paper cups that are durable for a long time.

Another object is to prevent leakage of liquid caused by penetration into paper material in the overlapped portion of side wall of paper cups and also avoid leakage from the joint of side wall and bottom plate of paper cups.

Further object of the present invention is to avoid leakage from cracks caused by folding in the laminated portion with synthetic resin in the cup made of paper or like materials.

To achieve the above objects, the paper cup of the present invention is such that the whole interior face of the side wall is formed of a coating layer with synthetic resin closely adhered thereto and also a coating layer of the same resin is applied on the inside face of a bottom plate and thereafter further coating is made between the lower peripheral edges of the side wall and bottom plate. Subsequently a coating layer of synthetic resin is applied to the top pheripheral edge of the side wall to be integral with side wall coating layer to completely seal the cup.

Other objects and features of the present invention will become more apparent as description proceeds with reference to accompanying drawings in which.

Figure 10:
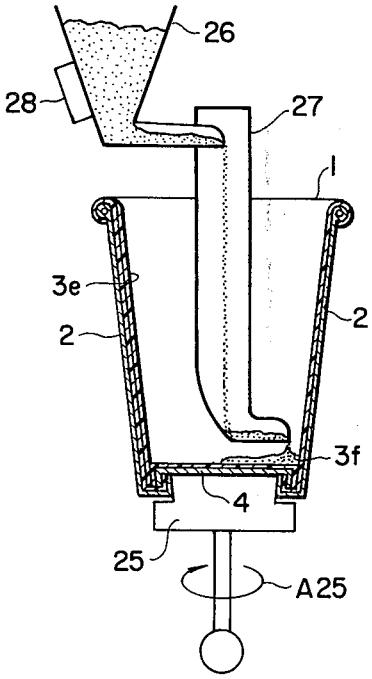
FIG. 10 is a diagrammatic section view of an equipment showing the way of coating for the portion shown in FIG. 7.
Figure 11:
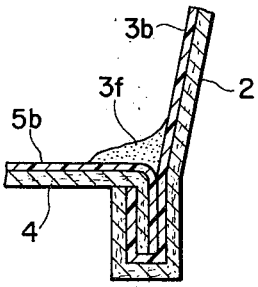

FIG. 11 a fragmentary enlarged portion of the cup shown in FIG. 10.

Figure 12:
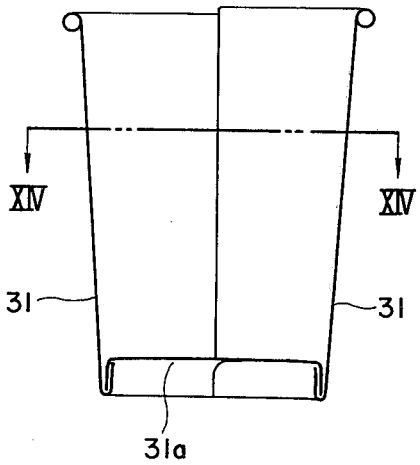

FIG. 12 is a longitudinal section view of a conventional type paper cup.

Figure 13:
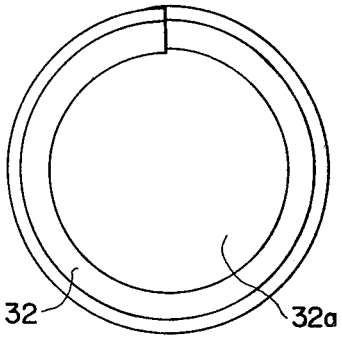

FIG. 13 is a plan view of the above paper cup.

Figure 14:
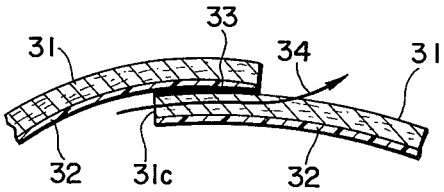

FIG. 14 is an enlarged section view taken along the line XIV—XIV in FIG. 12.

Figure 15:
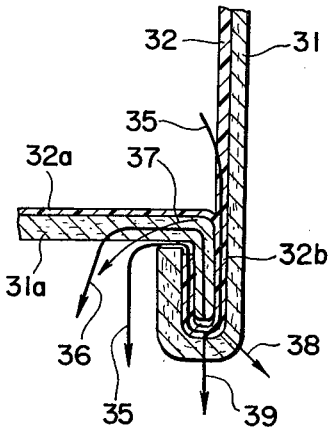

FIG. 15 is a fragmentary enlarged portion of FIG. 12.

Figure 16:
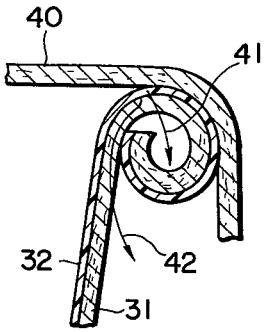

FIG. 16 is an enlarged section view of another part in FIG. 12 with a lid thereon.

Referring now to FIG. 1–FIG. 4, numeral 1 generally designates a paper cup. The overall inside face of its cylindrical side wall 2 is formed of a coating layer 3 of synthetic resin uniformly adhered. 4 is a bottom body on which is likewise coated with a synthetic resin layer 5. The lower peripheral edge of said side face coating layer 3 and the bottom face coating layer 5 are formed in continuation to be the inner wall of paper cup 1. 6 is an adhesive agent on the folded back portion of the side wall 2. 2*a* is the inside end of the overlapped portion of the side wall of the cup.

Figure 5:
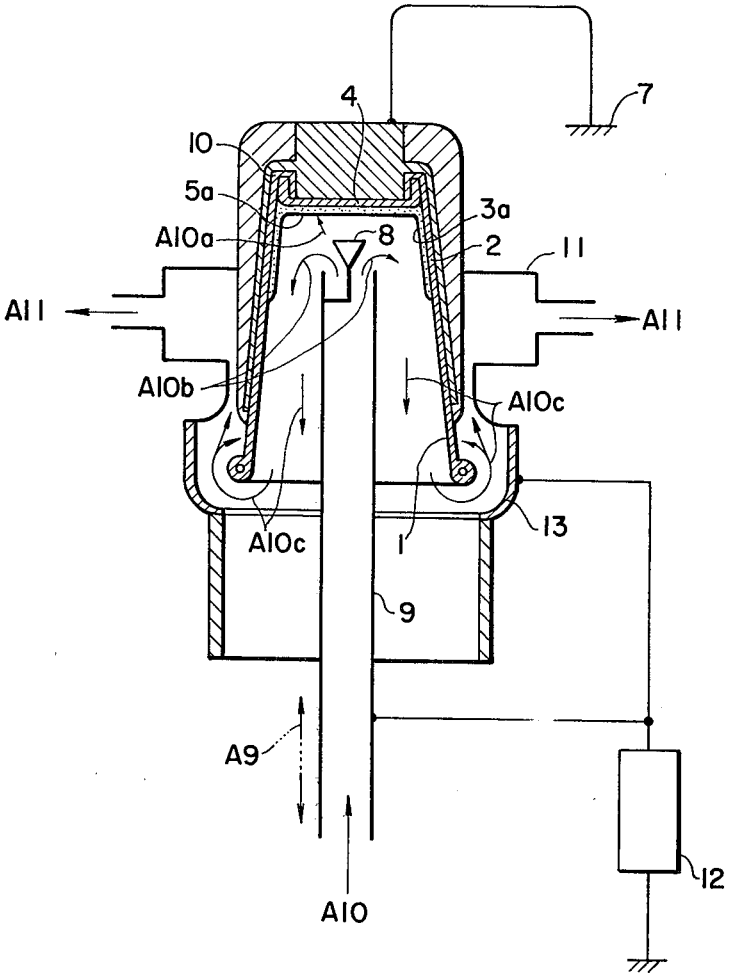
FIG. 5 is a diagrammatic view showing equipment to make up the cup in FIG. 1 through FIG. 4 with electric circuit.

In FIG. 5, 10 is a holder to hold the upside down paper cup 1. 7 is an earth. 8 is a distributor. 9 is a powder supplying pipe in which previously charged polyolefineous powder particles are sent in direction Arrow A10 to the top end of the powder supplying pipe 9 from where the powder particles blow in direction of Arrow A10*a* toward the bottom body 4 to form a powder layer 5*a*. Then the particles fall down in a direction of Arrow A10*b* along the inner face of the paper cup to form a powder layer 3*a* and furthe flow in a direction of Arrow A10*c* along the periphery open end of the cup 1.

In this instance, by virtue of electric field around the distributor 8, powder supplying pipe 9, guide member 13 and holder 10 generated by applied electric voltate, said charged powder particles attached on the inner face and peripheral open edge of the cup 1.

Not adhered powder particles entrained in air flow in direction A10*c* into an annular duct 11 and further flow to other equipment in direction A11. 12 is a high voltage electric source for said powder disposition. Powder supplying pipe 9 is made to be moved in vertical direction as shown by Arrow A9.

Thus the powder particles are deposited uniformly on the inner face of paper cup 1 and with subsequent heat treatment, the powder particles are moltonly adhered on the conical side wall to form the coating layer 3 and bottom coating layer 5 as an integral part of the cup.

Figure 1:
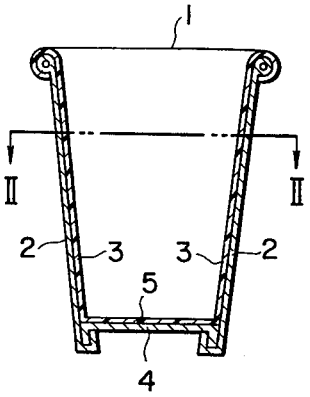
FIG. 1 is a longitudinal section view of a paper cup of one embodiment of the present invention.
Figure 2:
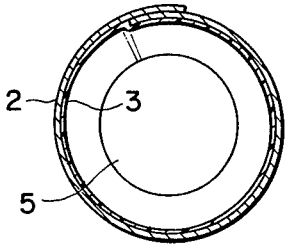
FIG. 2 is a section view taken along the line II—II in FIG. 1.
Figure 3:
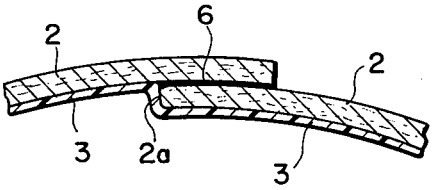
FIG. 3 is a partly enlarged section view of FIG. 2.
Figure 4:
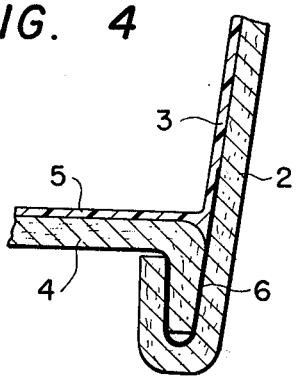
FIG. 4 is a partly enlarged section view of FIG. 1.
Figure 6:
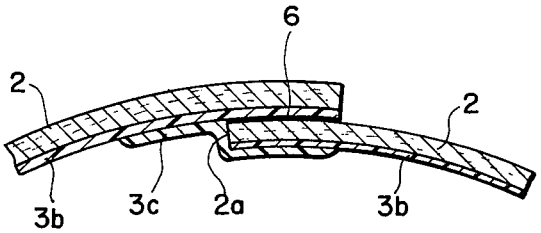
FIG. 6 is a fragmentary enlarged portion of another embodiment of the present invention corresponding to that in FIG. 3.
Figure 7:
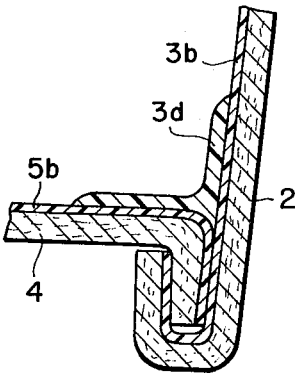
FIG. 7 is a fragmentary enlarged portion of the cup of same embodiment of the above corresponding to that in FIG. 4.

In FIG. 6 and FIG. 7, there is shown another embodiment of the present invention in which paper or the like material already laminated with synthetic resin is used. Therein 2 is side wall of the paper cup. 4 is a bottom body. 3*b* and 5*b* are each synthetic resin laminate layer. 3*c* is a synthetic resin coating layer covering one end 2*a* of inner wall and closely adhered to the overlapped portion of side wall 2.

Figure 8:
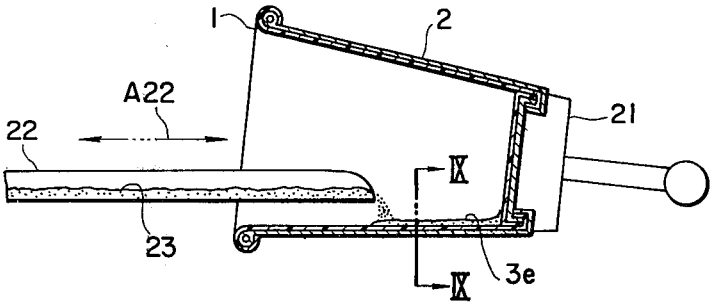
FIG. 8 is a diagrammatic section view showing the way of coating for the portion shown in FIG. 6.
Figure 9:
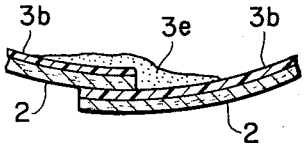
FIG. 9 is an enlarged section view taken along the line IX—IX in FIG. 8.

3*d* is an inner peripheral synthetic resin coating to jointly seal the side wall 2 and bottom body 4. That is, with end coating layer 3*c* and laminate layer 3*b*, the side wall sealing is established. Also with joint coating layer 3*d* and the joint coating layer 3*d* and laminate layer 3*b*, the bottom sealing is established. Shown in FIG. 8 and FIG. 9 is an equipment for forming the end coating layer 3*c* of FIG. 6. Therein a paper cup is firmly held by an holding tool 21. The powder supplying equipment 22 is moved in a direction of Arrow A22 along the inner end 2*a* supplying resin material same as said laminated or heat dissolving nature polyolefine synthetic resin to form a powder layer 3*e* and to be adhered thereto.

Shown in FIG. 10 is an equipment for forming the joint coating layer 3*d* in FIG. 7. Therein a cup is held by a turnable holder 25. From a hopper 26 through a guide duct 27 resin powder as said laminated material or heat dissolving nature systhetic resin powder 28 is supplied to the joint portion of said wall and bottom body 4 and by turning of the holder 25 in a direction of Arrow A25, a powder layer 3*f* is formed along the peripheral inside joint where the bottom body 25 and side wall are joined including the bent portion of the bottom body 4. With subsequent heat treatment said joint coating layer 3*d* is sealingly made.

Since the construction of paper cups of the present invention is as above, leakage of the liquid from the inner end 2*a* in the overlap portion of the side wall is avoided. Also any leakage from the joint portion of the side wall 2 and bottom body 4 will be avoided. Even if bent portion is cracked in the cup made of laminated paper material, any leakage will never occur.

Further since coating along the key joint portions is made with synthetic resin, its particular effect is very remarkable. Even when very hot liquid is filled therein, its coating layer will not fail. This is different from that of only waxed.

As above, two embodiments are described. However the present invention is not limited only thereto. Modifications may be made, as for example for the paper material described in the preceding embodiments, a material laminated with aluminum foil may be used.

Contrasted to the present invention, a conventional type paper cup as shown in FIGS. 12 through 16 and particularly in FIG. 14, is made with the inside face of the paper material 31 laminated with a layer 32 of synthetic resin and the overlapped portion is jointed only with an adhesive layer 33. In this, since the end 31*c* of paper material sheet 31 is sealed only with adhesive, the laminate layer 32 is not waterproof, particularly to the direction of Arrow 34. Because of this leakage tends to happen in the direction of Arrow 34. For this reason, such a paper cup is not suitable as a container for liquid to be stored for a long time.

To avoid such leakage, a way to seal that portion of the paper exposed in the inner face of cup is by spraying wax hereon. This may be somewhat effective if the laminate material is wax. However such cup can not be used for high temperature substances and further the wax tends to physically come off in a short time. Therefore its use is very much limited.

Another way to seal such an overlapped portion is by applying a solution of synthetic resin. However in case of the polyolefineous resin usually used as the laminate for the inner face of paper cups, the polyolefin itself is not soluble with ordinary solvents. Since no adhesive has been found which effectively bonds with polyolefine, it is impossible to adopt such way when polyolefine is used as the laminate material.

Therefore in paper cups laminated with polyolefineous resin, it has been deemed very difficult to find a way to avoid the leakage in said direction. This is a primary reason why the paper cups made from laminated paper can not be used as liquid containers for storing for a long time.

As seen in FIG. 15, in such paper cups made as a combination of a paper material member 31 and another member 31*a*, it is very difficult to completely seal the joint portion 32*b* because from such portion leakages tend to occur in the direction indicated by Arrow 35 and 36. Further, in such joint portion, since paper member 31 is folded at an acute angle, cracks tend to occur in the laminate layer 32*a* through which leakage occurs in the direction Arrow 37.

Similarly leakages caused by cracks in the laminate layer of the acutely folded portion often occur in direction of Arrows 38 and 39. This is a second reason why the paper cup made by assembling laminate paper materials can not be used as paper containers for liquid to be used for a long time.

As referred to in FIG. 16, in making a paper cup with a lid, the top end of the paper material wall 31 is folded with its laminate layer 32 on the top. For sealing the top open end of the wall 31, the aluminum lid 40 is usually heat welded with the resin of the laminate. In this instance, however, at the folded portion of the upper open end portion, the laminate layer tends to be cracked, particularly when the container filled with liquid falls, leakages in the folded portion tend to occur in the direction of the Arrows 41 and 42 caused by cracks in the laminate layer. This is a third reason why the paper cup which is only assembled from laminate papers can not be used as a container.

The present invention is intended to eliminate the above three defects and to provide a paper cup that can be kept for a long time.

What is claimed is:

1. In a cup suitable for holding and storing hot or cold liquids, said cup having a body of paper forming the sides thereof, a bottom of paper joined to said sides by a folded interlock, said sides at the top thereof being rolled into a lip; said sides having a seam formed of overlapping portions bonded together, the improvement comprising:

a continuous unitary liner of a film of liquid impervious, heat and cold resistant material formed on the assembled cup body and coating the inside surface of the sides and the bottom of said cup and extending around said rolled lip; said liner being securely bonded to said paper body.

2. A cup as described in claim 1 wherein said liner is of an electrostatically deposited polyolefineous material which has been fluidized to form a continuous layer on the assembled paper body.

* * * * *